US008172381B2

(12) United States Patent
Anderson, Jr. et al.

(10) Patent No.: US 8,172,381 B2
(45) **Date of Patent: *May 8, 2012**

(54) MULTI-COLOR INK TANK WITH FEATURES SPACED BY DISTANCES ENSURING INTERFACE WITH PRINTHEAD AND CARRIER SUPPORT STRUCTURE

(75) Inventors: James Daniel Anderson, Jr., Harrodsburg, KY (US); Jeffery James Buchanan, Lexington, KY (US); Stephen Porter Bush, Richmond, KY (US); Michael Clark Campbell, Lexington, KY (US); Johnnie Coffey, Winchester, KY (US); John Yeung Conway, Louisville, KY (US); Gina Marie Johns, Nicholasville, KY (US); Christopher Elliot Lingle, Lexington, KY (US); Jason Todd Vanderpool, Lexington, KY (US); Rita Greer, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 664 days.

This patent is subject to a terminal disclaimer.

(21) Appl. No.: 12/343,031

(22) Filed: Dec. 23, 2008

(65) Prior Publication Data

US 2010/0157004 A1 Jun. 24, 2010

(51) Int. Cl.
*B41J 2/175* (2006.01)

(52) U.S. Cl. ..... 347/86; 347/85; 347/87

(58) Field of Classification Search ..... 347/37, 347/49, 85–87, 93

See application file for complete search history.

(56) References Cited

U.S. PATENT DOCUMENTS

| | | | | |
|---|---|---|---|---|
| 6,224,192 | B1 * | 5/2001 | Robinson et al. | 347/49 |
| 6,394,593 | B1 * | 5/2002 | Komplin et al. | 347/86 |
| 6,481,829 | B1 * | 11/2002 | Bailey et al. | 347/49 |
| 7,905,572 | B2 | 3/2011 | Anderson | |
| 2007/0268344 | A1 * | 11/2007 | Anderson et al. | 347/86 |
| 2008/0036827 | A1 | 2/2008 | Anderson | |
| 2008/0186167 | A1 | 8/2008 | Adkins | |
| 2011/0032316 | A1 * | 2/2011 | Anderson et al. | 347/86 |

* cited by examiner

*Primary Examiner* — Ellen Kim

(57) ABSTRACT

A multi-color ink tank includes certain features that properly interface with features on a printhead and carrier support structure to operatively seat the ink tank in the carrier support structure in a sealed flow communicative relationship with the printhead. These interface features are spaced apart relative to one another at distances (or dimensions) that ensure the desired seating and sealing of the ink tank in the carrier support structure and thereby the reliable supply of ink for operation of the inkjet printing system.

11 Claims, 5 Drawing Sheets

MULTI-COLOR INK TANK WITH FEATURES SPACED BY DISTANCES ENSURING INTERFACE WITH PRINTHEAD AND CARRIER SUPPORT STRUCTURE

BACKGROUND

1. Field of the Invention

The present invention relates generally to inkjet printer systems and, more particularly, to an ink tank with features spaced apart by distances ensuring interface with a printhead and carrier support structure of an inkjet printing system.

2. Description of the Related Art

A conventional inkjet printing system forms an image on a print medium by ejecting ink from a plurality of ink jetting nozzles of an inkjet printhead to form a pattern of ink dots on the print medium. Inkjet printing is accomplished without contact between the printing system and the print medium. Such printing system typically includes a receptacle-like support structure mounted to a reciprocating carrier of the printing system. The carrier support structure permanently or at least semi-permanently mounts the inkjet printhead and also removably supports one or more ink containers or tanks in which ink is stored and from which ink is supplied to the printhead. The ink tanks may be removed and replaced once their ink is fully consumed during the printing operation.

Typically, a plurality of replaceable ink tanks are employed for supplying the printhead with inks of different colors, such as black (or mono), yellow, cyan and magenta. In one embodiment of the printing system, a multi-ink tank is utilized for holding the three ink colors, yellow, cyan and magenta, in separate compartments. The multi-color ink tank when properly seated in the carrier support structure mates in a sealed ink supplying relationship with the printhead mounted on the carrier support structure.

As disclosed in the first patent application cross-referenced above, the carrier support structure and the ink tanks have features that must properly interface with one another to operatively seat the ink tanks in the carrier support structure in the sealed flow communicative relationship with the printhead.

SUMMARY OF THE INVENTION

The present invention is directed to the provision of these interface features on an ink tank, such as a multi-color ink tank, and some other features thereon as well, spaced apart relative to one another at distances that ensure the desired seating and sealing of the multi-color ink tank in the printhead and carrier support structure and thereby the reliable supply of ink for the operation of the inkjet printing system.

Accordingly, in an aspect of the present invention, an ink tank with features spaced apart by distances ensuring interface with a printhead and carrier support structure of an inkjet printing system includes a reservoir body with a length, a width and a height, and having front and rear walls, right and left walls and a bottom wall connected together at respective right and left front and rear corners, right and left bottom corners, front and rear bottom corners, and right, left, front, rear top edges which merge to form a top rim defining a top opening in the reservoir body. The ink tank also comprises a top cover attached on the reservoir body so as to substantially close the top opening of the reservoir body for containing a supply of ink within at least one interior chamber of the ink tank. The ink tank further comprises a protrusion on the front wall having an upper edge disposed adjacent to the top rim and defining a lip on the protrusion adapted to engage a latch on a printhead, the lip enabling seating and releasable locking of the reservoir body therein. The ink tank still further includes a pair of protuberances on the rear wall laterally spaced apart and disposed adjacent to and above the rear bottom corner and diagonally across the reservoir body from the lip on the protrusion. The protuberances are adapted to insert into a slot in the printhead, the protuberances enabling seating and releasable locking of the reservoir body therein. The ink tank further includes a lower central recessed cavity formed in the reservoir body from and open at the rear and bottom walls and located between the protuberances for enabling the inserting and seating of the reservoir body in the carrier support structure. The ink tank also still further includes at least one snout on the bottom wall disposed closer to the front wall than to the rear wall and adapted to be in fluid communication with an orifice in a printhead as the reservoir body is pivotally inserted and seated in the carrier support structure.

A furthermost point of each protuberance is displaced from a furthermost point of the lip by a distance of no more than 78.0 mm as measured along an axis extending substantially parallel to the length of the reservoir body. The lip of the protrusion has a width within a range of from approximately 0.3 mm to 4.3 mm as measured along an axis extending substantially parallel to the width of the reservoir body. The lip of the protrusion also has a height extending above the top rim of the reservoir body at the front wall within a range of from approximately 0.3 mm to 17.5 mm as measured along an axis extending substantially parallel to the height of the reservoir body. Further, the lip of the protrusion is displaced from the outer surface of the bottom wall by a distance within a range of from approximately 33.7 mm to 34.3 mm as measured along an axis extending substantially parallel to the height of the reservoir body. The protuberance has a height extending above an outer surface of the bottom wall within a range of from approximately 0.3 mm to 4.6 mm as measured along an axis extending substantially parallel to height of the reservoir body. The central recessed cavity in the reservoir body extends to an inner wall displaced from the lip of the protrusion by a distance within a range of from approximately 52 mm to 56.8 mm as measured along an axis extending substantially parallel to length of the reservoir body. The snout has a central axis displaced from the lip of the protrusion by a distance within a range of from approximately 18.1 mm to 19.1 mm as measured along an axis extending substantially parallel to length of the reservoir body. The snout has a height extending below the outer surface of the bottom wall within a range of from approximately 1.2 mm to 3.8 mm as measured along an axis extending substantially parallel to height of the reservoir body.

BRIEF DESCRIPTION OF THE DRAWINGS

Figure 1:
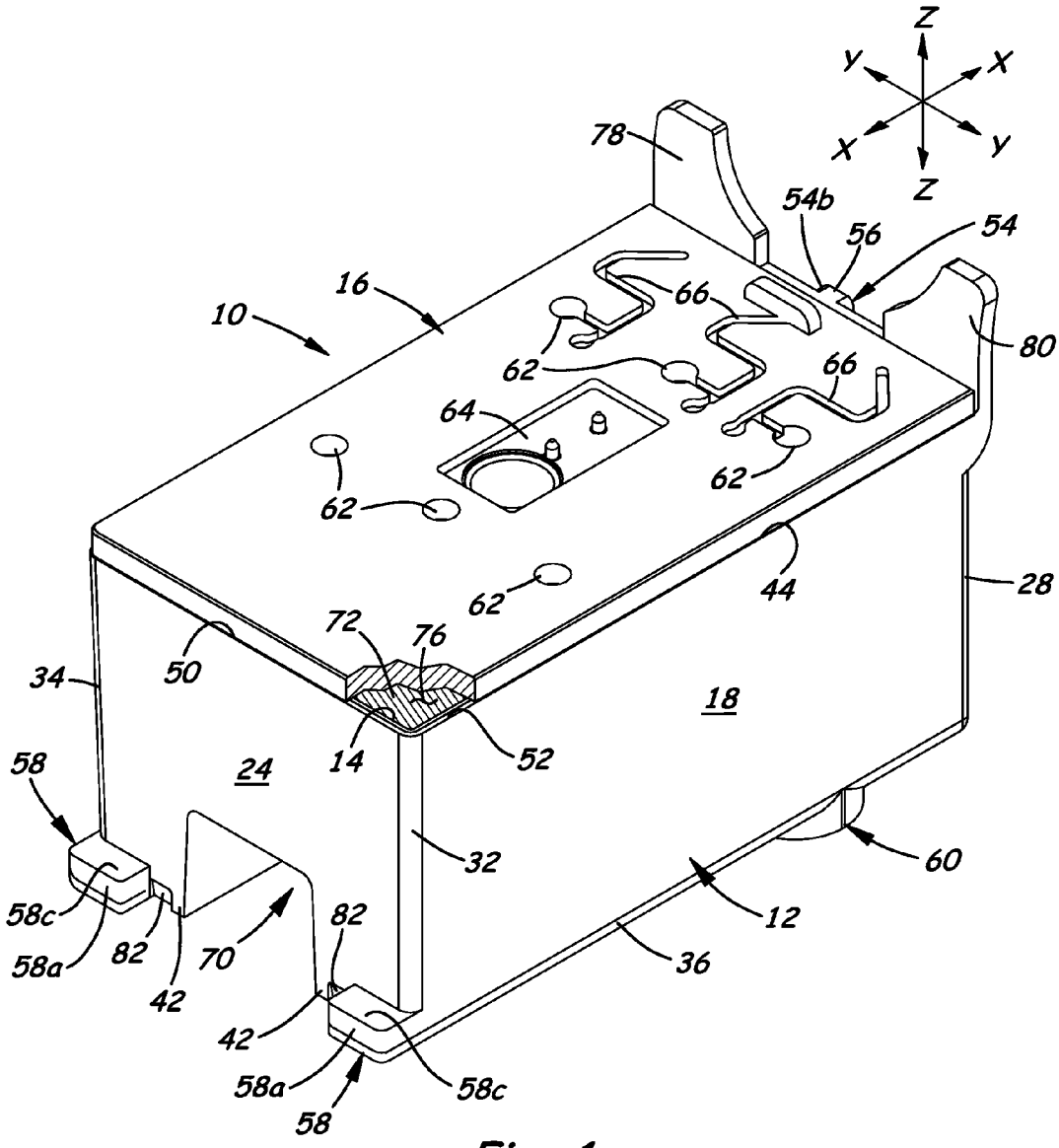

Having thus described the invention in general terms, reference will now be made to the accompanying drawings, which may or may not necessarily be drawn to scale, and wherein:

FIG. 1 is a perspective view of a multi-color ink tank having features spaced apart by distances in accordance with the present invention.

Figure 2:
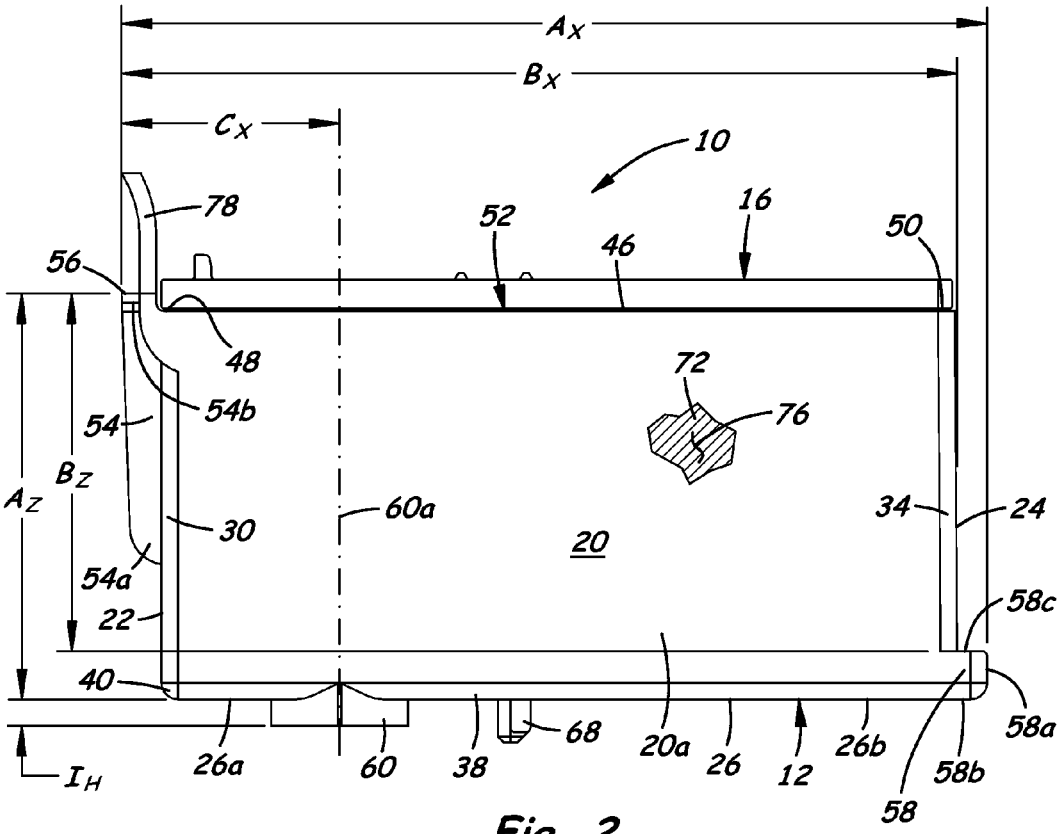

FIG. 2 is a side elevational view of the multi-color ink tank as seen from the left side of the ink tank in FIG. 1.

Figure 3:
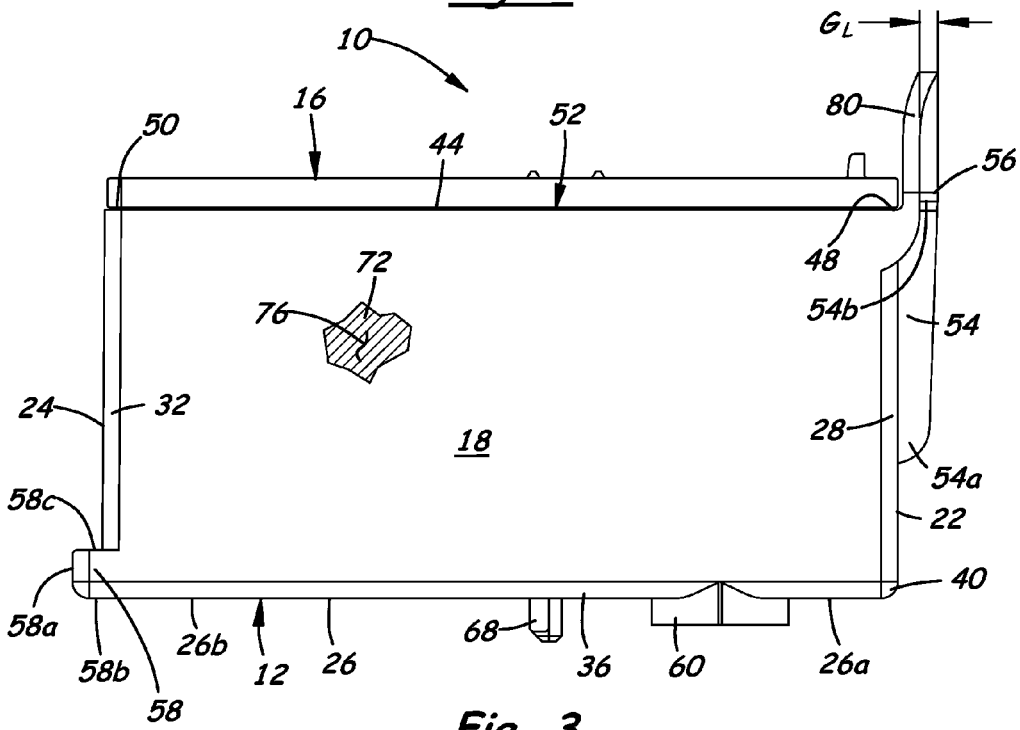

FIG. 3 is an opposite side elevational view of the multi-color ink tank as seen from the right side of the ink tank in FIG. 1.

Figure 4:
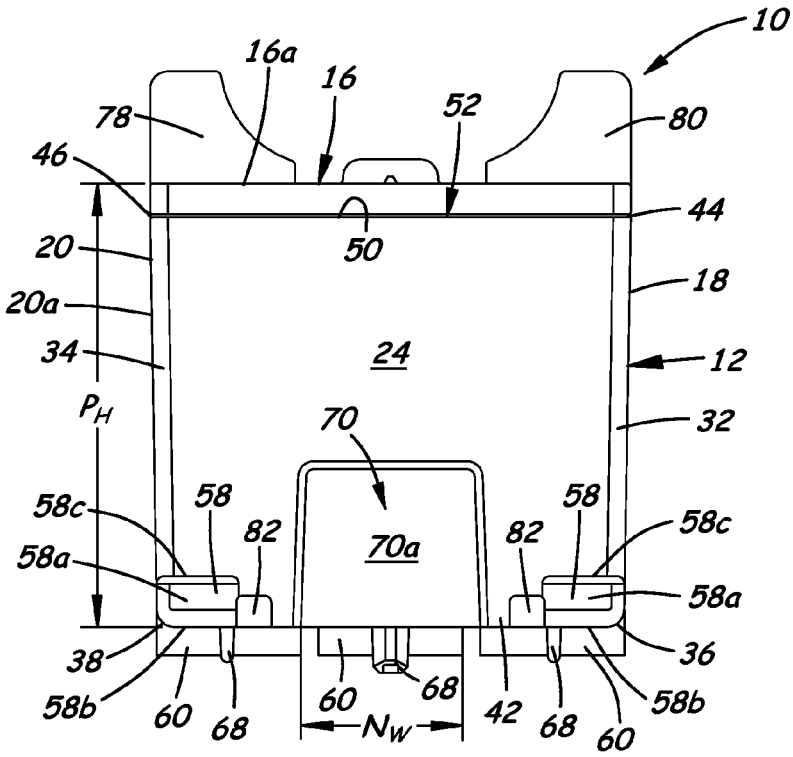

FIG. 4 is a rear end elevational view of the multi-color ink tank as seen from the near end of the ink tank in FIG. 1.

Figure 5:
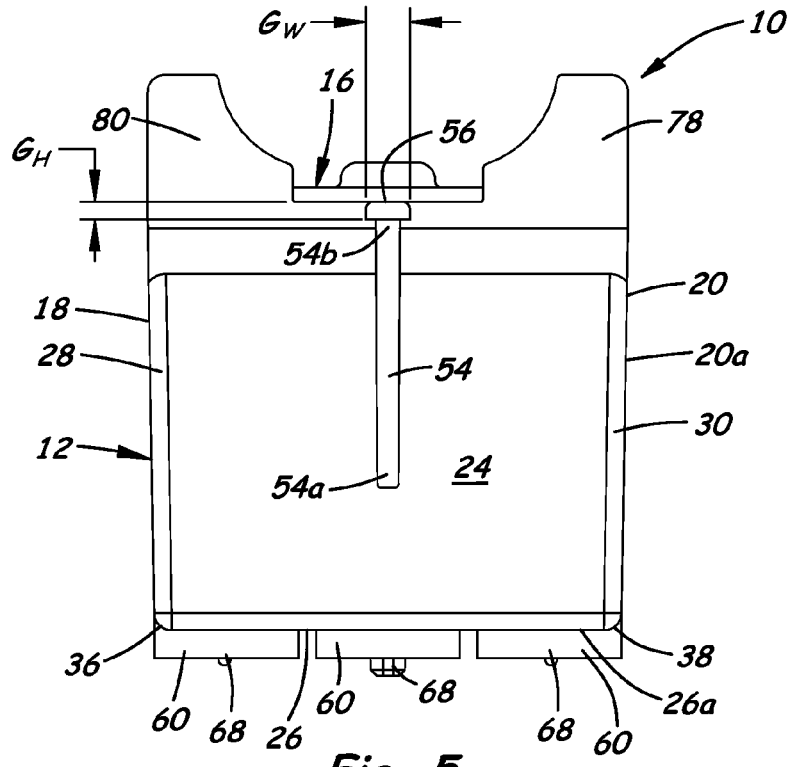

FIG. 5 is a front end elevational view of the multi-color ink tank as seen from the far end of the ink tank in FIG. 1.

Figure 6:
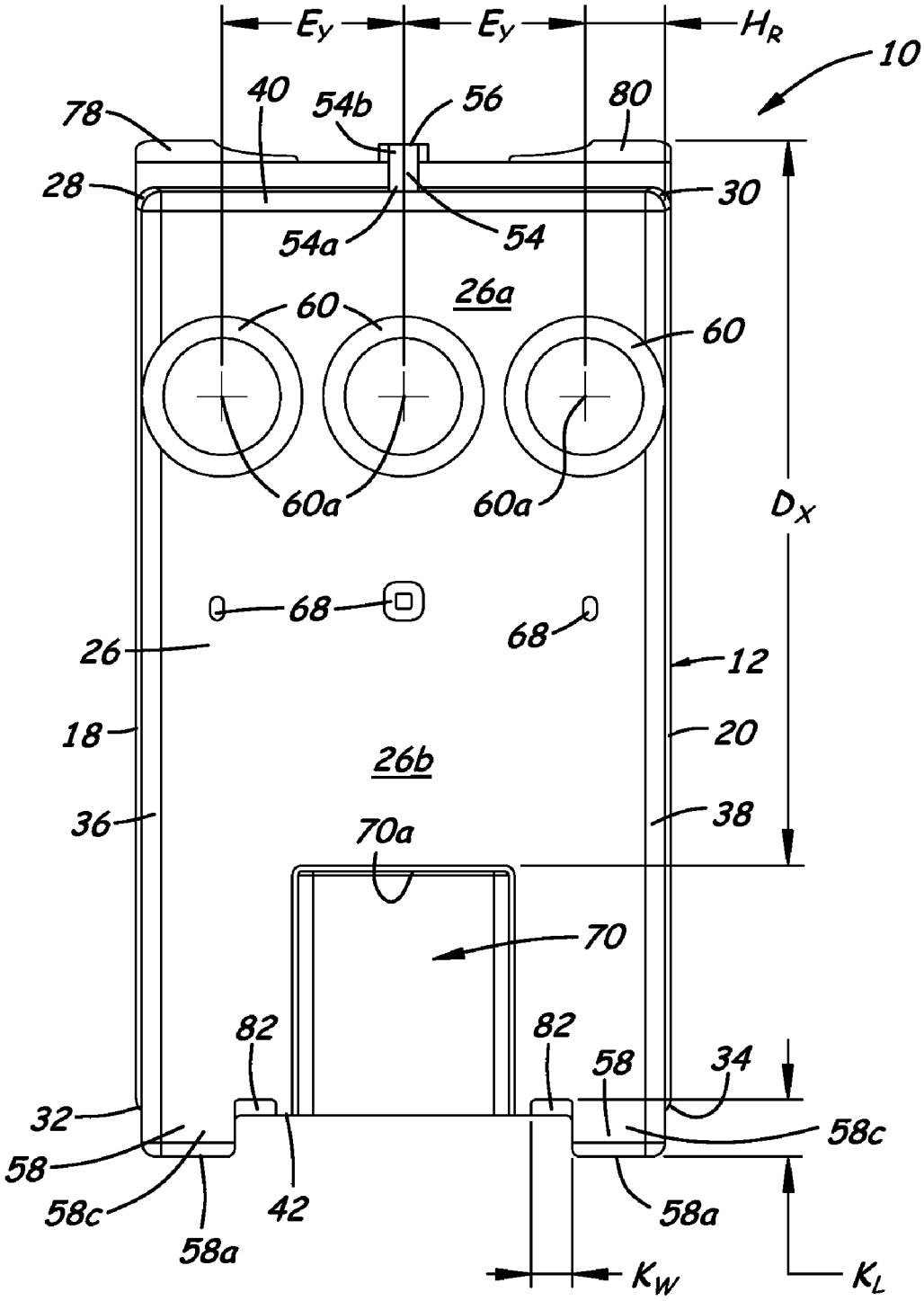

FIG. 6 is a bottom plan view of the multi-color ink tank of FIG. 1.

Figure 7:
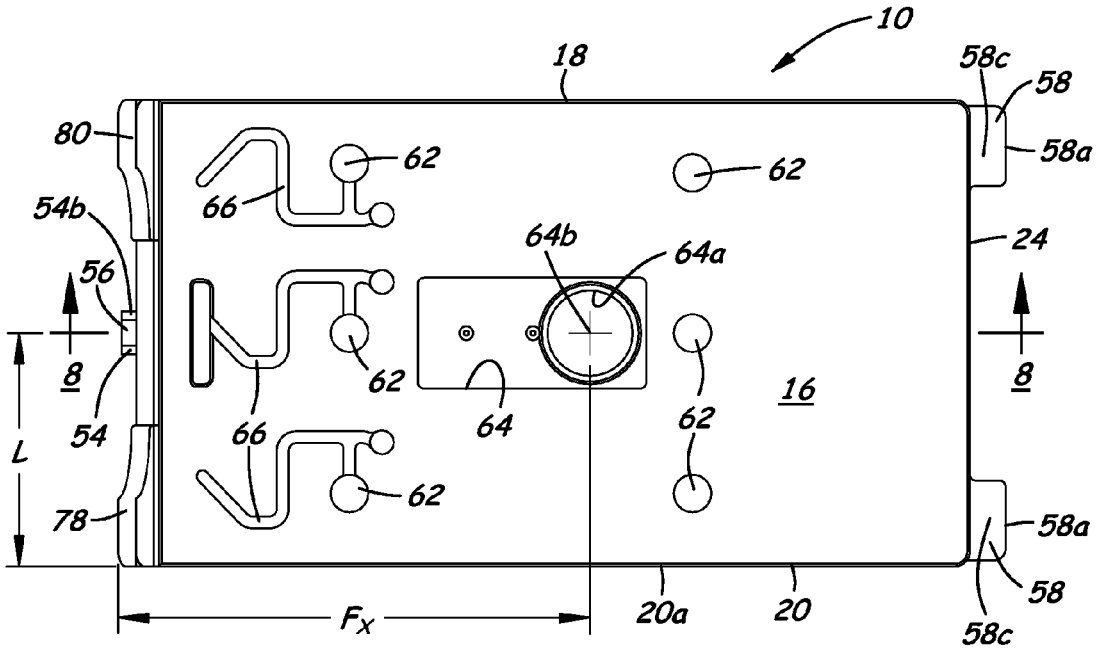

FIG. 7 is a top plan view of the multi-color ink tank of FIG. 1.

Figure 8:
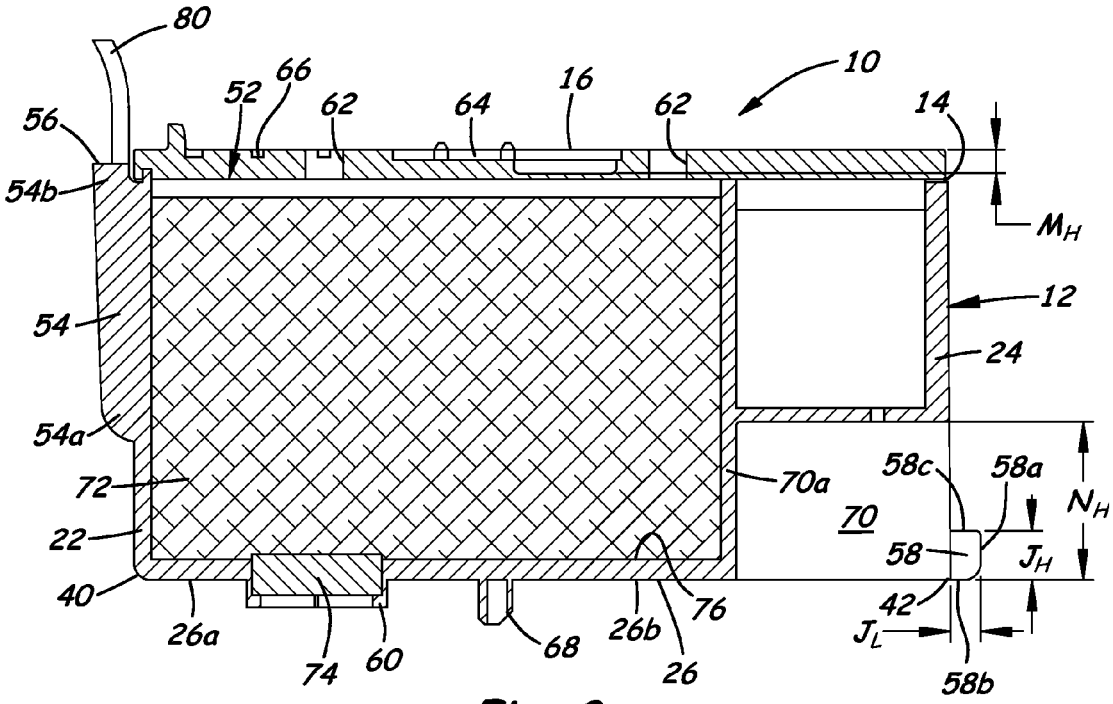

FIG. 8 is a longitudinal sectional view of the multi-color ink tank taken along line 8-8 in FIG. 7.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views. Words such as 'right', 'left', 'front', 'rear' and the like are used herein for purposes of convenience in describing an exemplary embodiment of the invention, not for purposes of limitation of the scope of the invention.

Referring now to FIG. 1, there is illustrated an ink tank, generally designated 10, such as a multi-color ink tank, having features spaced apart by distances (dimensions) in accordance with the present invention. These distances ensure operative interfacing of the ink tank 10 with a printhead (not shown) and carrier support structure (not shown) of an inkjet printing system. An adequate understanding of a printhead and a carrier support structure, to enable one of ordinary skill in the art to understand the description hereinafter of the interface features and distances between them on the ink tank 10, can be gained from the first patent application cross-referenced above.

Referring to FIGS. 1-6, it may be seen that the ink tank 10 basically includes a reservoir body 12 for containing a supply of ink. The reservoir body 12 has a top opening 14. The ink tank 10 further includes a top cover 16 attached to the reservoir body 12, in any suitable well-known manner, so as to close its top opening 14 and form a hermetic seal with the reservoir body 12, thereby containing the supply of ink. The reservoir body 12 includes pair of substantially parallel, right and left walls 18, 20, a pair of substantially parallel, front and rear walls 22, 24 extending substantially perpendicular to and between the right and left walls 18, 20, and a bottom wall 26 extending substantially perpendicular to and between the right and left walls 18, 20 and front and rear walls 22, 24. The right and left walls 18, 20, front and rear walls 22, 24 and bottom wall 26 are integrally connected together to provide the reservoir body 12. The reservoir body 12 may be fabricated as a unitary component by employment of suitable fabrication processes well-know to those of ordinary skill in the art. The right and front walls 18, 22 form a right front corner 28 between them. The left and front walls 20, 22 form a left front corner 30 between them. The right and rear walls 18, 24 form a right rear corner 32 between them. The left and rear walls 20, 24 form a left rear corner 34 between them. The right and bottom walls 18, 26 form a right bottom corner 36 between them. The left and bottom walls 20, 26 form a left bottom corner 38 between them. The front and bottom walls 22, 26 form a front bottom corner 40 between them. The rear and bottom walls 24, 26 form a rear bottom corner 42 between them. The right, left, front, rear walls 18, 20, 22, 24 also have right, left, front, rear top edges 44, 46, 48, 50 which merge into one another and together form a continuous or endless top rim 52 which defines the top opening 14 on the reservoir body 12 of the ink tank 10.

The ink tank 10 also includes certain interface features that must properly interface with features on the printhead and carrier support structure to operatively seat, seal and lock the ink tank 10 in the carrier support structure in a sealed flow communicative relationship with the printhead. It is these interface features that are spaced apart relative to one another at distances (or dimensions) that ensure the desired seating and sealing of the ink tank 10 in the carrier support structure and thereby the reliable supply of ink for operation of the inkjet printing system.

Turning now to FIGS. 1-3 and 5-8, there is shown a first of these interface features on the reservoir body 12 of the ink tank 10 which takes the form of a protrusion 54. The protrusion 54 is integrally formed on and protrudes forwardly from the front wall 22 of the reservoir body 12. The protrusion 54 tapers slightly forwardly going from its lower end 54*a* to its upper end 54*b* such that it terminates at its upper end 54*b* at a lip 56 that is its most forward projecting point and one that is at a level spaced by a small distance above the endless top rim 52 of the reservoir body 12. The height of the protrusion 54 is substantially greater than its length or width such that it is configured as a narrow rib running height-wise along the front wall 22 of the reservoir body 12.

By protruding forwardly and diverging from the front wall 22 going from its lower end 54*a* to its upper end 54*b*,the protrusion 54 engages and deflects a complementary interface feature in the form of a deformable latch, as disclosed in the first patent application cross-referenced above, on a front portion of the carrier support structure as the ink tank 10 is pivotally inserted into the carrier support structure. Then, once the lip 56 is located below an upper end of a slot in the corresponding latch on the carrier support structure, as the ink tank 10 reaches a fully seated position in the carrier support structure, the lip 56 makes a snap-fit engagement with the latch in which the protrusion 54 projects into the latch slot and the lip 56 underlies an interior edge portion of the latch defining the upper end of the slot. As will become clear below, the location of the lip 56 on the protrusion 54 is coordinated with the locations of the other interface features of the reservoir body 12 of the ink tank 10 such that when they are displaced from each other by distances within approximate ranges as will be set forth below, the ink tank 10 is releasably seatable and lockable in the carrier support structure so as to thereby ensure the reliable supply of ink for operation of the inkjet printing system.

Turning now to FIGS. 1-4 and 6-8, there is shown a second of these interface features on the reservoir body 12 of the ink tank 10 which takes the form of a pair of feet or protuberances 58 formed on the rear wall 24 of the reservoir body 12. The protuberances 58 are located just above the rear bottom corner 42, protrude rearward from the rear wall 24, and are spaced apart from each other width-wise of the reservoir body 12. At such location on the reservoir body 12, the protuberances 58 are located approximately diagonally opposite and across from the lip 56 of the protrusion 54 on the reservoir body 12.

By protruding rearward from the rear wall 24 of the reservoir body 12 just above the rear bottom corner 42, the protuberances 58 are insertable into complementary interface features in the form of corresponding slots, as disclosed in the first patent application cross-referenced above, defined on a rear portion of the carrier support structure. Insertion of the protuberances 58 into such slots occurs at the start or initiation of installing the ink tank 10 into the carrier support structure. These slots in the rear portion of the carrier support structure are located diagonally opposite and across from the above-described latch on its front portion.

Turning now to FIGS. 1-6 and 8, there is shown a third of these interface features on the reservoir body 12 of the ink tank 10 which takes the form of at least one and preferably three snouts 60 formed on the bottom wall 26 of the reservoir body 12. The snouts 60 protrude downward from the bottom wall 26 and are spaced apart from each other width-wise of the reservoir body 12. At such locations on the reservoir body 12, the snouts 60 are positioned substantially closer to the front wall 22 than the rear wall 24 of the reservoir body 12 and aligned for sealably mating with orifices in the printhead, as disclosed in the first patent application cross-referenced above. The snouts 60 are of cylindrical shape, but may have other configurations as well.

The snouts 60 are sufficiently displaced away from the front bottom corner 40 of the reservoir body 12 to leave a sufficient solid area 26*a* of the bottom wall 26 to overlie at least one and preferably a plurality of springs, as disclosed in the first patent application cross-referenced above, supported on the bottom of the carrier support structure adjacent to its latch. The springs are yieldably depressed by engagement with this solid area 26*a* of the bottom wall 26 of the reservoir body 12 as the ink tank 10 is pivoted forward and downward, generally about the location of the rear slots of the carrier support structure when the protuberances 58 of the reservoir body 12 inserted therein, to the fully seated upright position in the carrier support structure.

Installing the multi-color ink tank 10 in the carrier support structure involves: first, tilting the ink tank 10 to enable inserting its rear protuberances 58 into the rear slot of the carrier support structure; next, pivoting the ink tank 10 forward and downward toward the upright seated position in the carrier support structure; and, finally, seating the ink tank 10 in the carrier support structure by contacting the protrusion 54 against the latch of the carrier support structure and then deflecting the latch forwardly, concurrently depressing the spring with the bottom wall 26 of the reservoir body 12 of the ink tank 10 and forcing the sealing insertion of the snouts 60 of the ink tank 10 into the orifices of the printhead on the carrier support structure, until the protrusion 54 on the ink tank 10 has sufficiently deflected the latch to enable the lip 56 to snap-fit into the slot in the latch. The upwardly directed force of the depressed springs against the bottom wall 26 of the ink tank 10 maintains the ink tank 10 seated, with its protuberances 58 inserted through the slots, and thus locked in the carrier support structure.

There are additional interface and non-interface features incorporated by the ink tank 10. As seen in FIGS. 1 and 7, there is a pattern of fill holes 62, an RFID tag mounting recess 64 and a pattern of air vents 66 defined in the top cover 16 of the ink tank 10. As seen in FIGS. 2-6 and 8, there are alignment studs 68 spaced from one another and attached across the center on the bottom wall 26 and projecting downward therefrom which insert into corresponding holes in the carrier support structure when the ink tank 10 is fully seated therein. As seen in FIGS. 1, 4, 6 and 8, there is a lower central recessed cavity 70 formed in the reservoir body 12 so as to extend inward from and open at the rear wall 24 which makes the multi-color ink tank 10 compatible with a carrier support structure originally designed to receive and seat only individual color ink tanks, as disclosed in the first patent application cross-referenced above. As seen in FIG. 8, there is a negative pressure producing felt material 72 and a wick 74 filling respectively the space of an interior chamber 76 in the reservoir body 12 and the snouts 60 on the reservoir body 12. The felt material 72 and the wick 74 are highly porous so as to retain the ink that is present in the chamber 76 and snouts 60 but still release it when communication is established between the orifices of the printhead and the chamber 76 via the snouts 60. Finally, as seen in FIGS. 1-8, there are individual color keys 78, 80 mounted and attached on the front wall 22 of the reservoir body 12 and extending above the cover 16, and recessed keys 82 formed in the rear wall 24 and located between the lower central recessed cavity 70 and the protuberances 58.

Most of the distances (or dimensions) given are measurements that locate various ones of the above-described interface features and other features of the reservoir body 12 of the ink tank 10 relative to the lip 56 in a three-dimensional reference field having the orthogonal X, Y, Z axes (see FIG. 1). However, some of the distances (or dimensions) are lengths, widths and/or heights of particular interface features of the ink tank 10 extending along the same reference field. As seen in FIG. 1, the X and Y axes both extend in a substantially horizontal plane and the Z axis in a substantially vertical plane. Furthermore, the X, Y, Z axes extend substantially parallel to the length, width and height of the reservoir body 12 which likewise extend in the same respective planes.

The various distances (or dimensions) as provided herein are in millimeter (mm) units and identified by the noted reference letters in the various ones of FIGS. 1-8. First listed below are the distances along at least one of X, Y and Z axes that originate at the lip 56, as follows:

| Ref. Letter | Distance | Ref. Letter | Distance |
|---|---|---|---|
| $A_X$ | 72.3 to 78.0 max | $A_Z$ | 33.7 to 34.3 max |
| $B_X$ | 69.8 to 72.1 max | $B_Z$ | 29.7 to 33.4 max |
| $C_X$ | 18.6 to 18.1 min, 19.1 max | $D_X$ | 52 to 56.8 max |
| $E_Y$ | 12.8 to 12.3 min, 13.3 max | $F_X$ | 38.3 to 33.8 min, 43.3 max. |

Other distances (or dimensions), with L standing for length, H standing for height, W standing for width, and R standing for radius, of various ones of the interface and other features described above are as follows:

| | | | |
|---|---|---|---|
| $G_L$ | 1.3 to 0.5 min, 4.5 max | $G_W$ | 3.6 to 0.3 min, 4.3 max |
| $G_H$ | 1.5 to 0.3 min, 17.5 max | $H_R$ | 5.5 to 5 min, 6 max |
| $I_H$ | 2.3 to 1.2 min, 3.8 max | $J_L$ | 2.5 to 1.2 min |
| $J_H$ | 4 to 4.6 max | $K_L$ | 3.4 to 3.2 min, 4.4 max |
| $K_W$ | 2.4 to 1.8 min, 10.2 max | L | 18.7 to 15.7 min, 21.7 max |
| $M_H$ | 2.1 to 4.0 max | $N_H$ | 12.9 to 12.3 min |
| $N_W$ | 14.7 to 13.8 min | $P_H$ | 34.9 to 29.9 min, 39.9 max |

Thus, each protuberances 58 at a rear surface 58*a* thereon is displaced from the lip 56 of the protrusion 54 by a distance $A_X$ within a range of from approximately 72.3 mm to 78.0 mm, as measured along the X axis extending substantially parallel to the length of the reservoir body 12. Each protuberance 58 has a height $J_H$ extending above an outer surface 26*b* of the bottom wall 26 within a range of from approximately 0.3 mm to 4.6 mm, as measured along the Z axis extending substantially parallel to the height of the reservoir body 12. The bottom surface 58*b* of each protuberance 58 which is coplanar with the outer surface 26*b* of the bottom wall 26 is displaced from the lip 56 of the protrusion 54 by a distance $A_Z$ within a range of from approximately 33.7 mm to 34.3 mm, as measured along the Z axis extending substantially parallel to the height of the reservoir body 12. Each protuberance 58 at a top surface 58*c* thereon is displaced from the lip 56 of the protrusion 54 by a distance $B_Z$ within a range of from approximately 29.7 mm to 33.4 mm, as measured along the Z axis extending substantially parallel to the height of the reservoir body 12. Each protuberance 58 has a length $J_L$ extending along the outer surface 26*b* of the bottom wall 26 within a range of from approximately 1.2 mm to 2.5 mm, as measured along the X axis extending substantially parallel to the length of the reservoir body 12.

The snouts 60 have central axes 60*a* displaced from the lip 56 of the protrusion 54 by a distance $C_X$ within a range of from approximately 18.1 mm to 19.1 mm, as measured along the X axis extending substantially parallel to the length of the reservoir body 12. The snout 60 has a height $I_H$ extending below the outer surface 26*b* of the bottom wall 26 within a range of from approximately 1.2 mm to 3.8 mm, as measured along the Z axis extending substantially parallel to the height of the reservoir body 12. The central axes 60*a* of the snouts 60 are displaced by a distance $E_Y$ within a range of from approximately 12.3 mm to 13.3 mm and in an exemplary embodiment is 12.8 mm, as measured along the Y axis extending substantially parallel to the width of the reservoir body 12. The radius $H_R$ of each snout 60 is within a range of from approximately 5 mm to 6 mm and in an exemplary embodiment is 5.5 mm, as measured along the Y axis extending substantially parallel to the width of the reservoir body 12.

The lip 56 of the protrusion 54 has a length $G_L$ extending from the front top edge 48 of the front wall 22 within a range of from approximately 0.5 mm to 4.5 mm, as measured along the X axis extending substantially parallel to the width of the reservoir body 12. The lip 56 of the protrusion 54 also has a width $G_W$ within a range of from approximately 0.3 mm to 4.3 mm and in an exemplary embodiment is 3.6 mm, as measured along the Y axis extending substantially parallel to the width of the reservoir body 12. The lip 56 of the protrusion 54 further has a height $G_H$ within a range of from approximately 0.3 mm to 17.5 mm and in an exemplary embodiment is 1.5 mm, as measured along the Z axis extending substantially parallel to the height of the reservoir body 12. The lip 56 of the protrusion 54 is displaced from the outer surface 24*a* of the rear wall 24 by a distance $B_X$ within a range of from approximately 69.8 mm to 72.1 mm, as measured along the X axis extending substantially parallel to the length of the reservoir body 12.

The lower central recessed cavity 70 extends to an inner wall 70*a* displaced from the lip 56 of the protrusion 54 by a distance $D_X$ within a range of from approximately 52 mm to 56.8 mm, as measured along the axis X extending substantially parallel to length of the reservoir body 12. The lower central recessed cavity 70 also has a height $N_H$ extending above an outer surface 26*b* of the bottom wall 26 within a range of from approximately 12.3 mm to 12.9 mm, as measured along the Z axis extending substantially parallel to the height of the reservoir body 12. The lower central recessed cavity 70 further has a width $N_W$ within a range of from approximately 13.8 to 14.7, as measured along the Y axis extending substantially parallel to width of the reservoir body 12. Each recessed key 82 extends into the rear wall 24 from the rear surface 58*a* of a respective protuberance 58 through a distance $K_L$ within a range of from approximately 3.2 mm to 4.4 mm and in an exemplary embodiment is 3.4 mm, as measured along the X axis extending substantially parallel to the length of the reservoir body 12. Each recessed key 82 ha a width $K_W$ within a range of from approximately 1.8 mm to 10.2 mm and in an exemplary embodiment is 2.4 mm, as measured along the Y axis extending substantially parallel to the width of the reservoir body 12.

The top cover 16 has a height $M_H$ extending above the top rim 52 within a range of from approximately 2.1 mm to 4.0 mm, as measured along the Z axis extending substantially parallel to the height of the reservoir body 12. The ink tank 10 has a height $P_H$ extending between the outer surface 26*b* of the bottom wall 26 and a top surface 16*a* of the top cover 16 within a range of from approximately 29.9 to 39.9 and in an exemplary embodiment is 34.9 mm, as measured along the Z axis extending substantially parallel to the height of the reservoir body 12.

A central depression 64*a* in the RFID tag mounting recess 64 has a central axis 64*b* displaced from the lip 56 of the protrusion 54 by a distance $F_X$ within a range of from approximately 33.8 mm to 43.3 mm and in an exemplary embodiment is 38.3 mm, as measured along the X axis extending substantially parallel to the length of the reservoir body 12. Also, the central axis 64*b* of the central depression 64*a* is displaced from the outer surface 20*a* of the left wall 20 by a distance L within a range of from approximately 15.7 mm to 21.7 mm and in an exemplary embodiment is 18.7 mm, as measured along the Y axis extending substantially parallel to the width of the reservoir body 12.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. An ink tank with features spaced apart by distances ensuring interface with a printhead and carrier support structure of an inkjet printing system, comprising:

a reservoir body with a length, a width and a height and having opposite front and rear walls, right and left walls and a bottom wall connected together at respective right and left front and rear corners, right and left bottom corners, front and rear bottom corners, and a top rim on the walls defining a top opening on said reservoir body;

a top cover attached on said reservoir body so as to substantially close said top opening of said reservoir body for containing a supply of ink within at least one interior chamber of said ink tank;

a protrusion on said front wall having an upper edge disposed adjacent to said top rim and defining a lip on said protrusion adapted to engage a latch on a printhead, the lip enabling seating of said reservoir body therein;

a pair of protuberances on said rear wall laterally spaced apart and disposed adjacent to and above said rear bottom corner and diagonally across said reservoir body from said lip on said protrusion on said front wall, said protuberances adapted to insert into a slot in the printhead, the protuberances for enabling seating and releasable locking of said reservoir body therein;

a lower central recessed cavity formed in said reservoir body extending from and open at said rear and bottom walls and located between said protuberances for enabling inserting and seating of said reservoir body in the carrier support structure; and at least one snout on said bottom wall disposed closer to said front wall than to said rear wall and adapted to be in fluid communication with an orifice in a printhead as said reservoir body is pivotally inserted and seated in the carrier support structure;

wherein a furthermost point of said each protuberance is displaced from a furthermost point of said lip by a distance of no more than 78.0 mm, as measured along an axis extending substantially parallel to the length of said reservoir body;

said each protuberance having a height extending above an outer surface of said bottom wall within a range of from approximately 0.3 mm to 4.6 mm, as measured along an axis extending substantially parallel to the height of said reservoir body;

said snout having a central axis displaced from said lip of said protrusion by a distance within a range of from approximately 18.1 mm to 19.1 mm, as measured along an axis extending substantially parallel to the length of said reservoir body;

said snout having a height extending below said outer surface of said bottom wall within a range of from approximately 1.2 mm to 3.8 mm, as measured along an axis extending substantially parallel to the height of said reservoir body.

2. The ink tank of claim 1 wherein said lip of said protrusion has a length extending from said top rim at said front wall within a range of from approximately 0.5 mm to 4.5 mm, as measured along an axis extending substantially parallel to the length of said reservoir body.

3. The ink tank of claim 1 wherein said lower central recessed cavity extends to an inner wall displaced from said lip of said protrusion by a distance within a range of from approximately 52 mm to 56.8 mm, as measured along an axis extending substantially parallel to the length of said reservoir body.

4. The ink tank of claim 1 wherein said lower central recessed cavity has a height extending above an outer surface of said bottom wall within a range of from approximately 12.3 mm to 12.9 mm, as measured along an axis extending substantially parallel to the height of said reservoir body.

5. The ink tank of claim 1 wherein said lower central recessed cavity has a width within a range of from approximately 13.8 mm to 14.7 mm, as measured along an axis extending substantially parallel to the width of said reservoir body.

6. The ink tank of claim 1 wherein said lip of said protrusion has a width within a range of from approximately 0.3 mm to 4.3 mm, as measured along an axis extending substantially parallel to the width of said reservoir body.

7. The ink tank of claim 1 wherein said lip of said protrusion has a height extending above said tip rim at said front wall within a range of from approximately 0.3 mm to 17.5 mm, as measured along an axis extending substantially parallel to the height of said reservoir body.

8. The ink tank of claim 1 wherein said top cover has a thickness within a range of from approximately 2.1 mm to 4.0 mm.

9. The ink tank of claim 1 wherein a furthermost point of said top cover is displaced from a furthermost point of aid bottom wall by a distance of no more than 39.9 mm, as measured along an axis extending substantially parallel to the height of said reservoir body.

10. The ink tank of claim 1 wherein said top cover has a RFID tag mounting recess with a central depression therein have a central axis displaced from said lip by a distance within a range of from approximately 33.8 mm to 43.3 mm, as measured along an axis extending substantially parallel to the length of said reservoir body.

11. The ink tank of claim 1 wherein said top cover has a RFID tag mounting recess with a central depression therein having a central axis displaced from said outer surface of said left wall by a distance within a range of from approximately 15.7 mm to 21.7 mm, as measured along an axis extending substantially parallel to the width of said reservoir body.

* * * * *